US008183999B1

(12) United States Patent
Giallorenzi et al.

(10) Patent No.: US 8,183,999 B1
(45) Date of Patent: May 22, 2012

(54) EMERGENCY LOCATING SYSTEM AND METHOD USING SPREAD-SPECTRUM TRANSCEIVER

(75) Inventors: Thomas R. Giallorenzi, Sandy, UT (US); Eric K. Hall, Salt Lake City, UT (US); Michael D. Pulsipher, Syracuse, UT (US); Kyle L. Henderson, Lehi, UT (US); Kent M. Erickson, Salt Lake City, UT (US); Marc J. Russon, Salt Lake City, UT (US)

(73) Assignee: L-3 Communications, Corp., New York, NY (US)

( * ) Notice: Subject to any disclaimer, the term of this patent is extended or adjusted under 35 U.S.C. 154(b) by 706 days.

(21) Appl. No.: 12/350,082

(22) Filed: Jan. 7, 2009

(51) Int. Cl.
*G08B 1/08* (2006.01)

(52) U.S. Cl. ..... 340/539.13; 340/539.21; 340/573.1; 340/573.4; 340/686.6; 340/568.1; 455/404.1; 455/553.1; 455/456.1

(58) Field of Classification Search ..... 340/539.13, 340/539.21, 573.1, 573.4, 568.1, 686.6; 455/404.1, 455/456.1, 553.1
See application file for complete search history.

(56) References Cited

U.S. PATENT DOCUMENTS

| | | | | |
|---|---|---|---|---|
| 4,357,609 | A | 11/1982 | Spencer | |
| 5,150,310 | A | 9/1992 | Greenspun et al. | |
| 5,874,897 | A * | 2/1999 | Klempau et al. | 340/573.1 |
| 5,929,777 | A | 7/1999 | Reynolds | |
| 6,324,392 | B1 * | 11/2001 | Holt | 455/404.2 |
| 6,545,606 | B2 | 4/2003 | Piri et al. | |
| 6,889,135 | B2 | 5/2005 | Curatolo et al. | |
| 6,898,197 | B1 | 5/2005 | Lavean | |
| 6,907,238 | B2 * | 6/2005 | Leung | 455/404.1 |
| 7,126,536 | B2 | 10/2006 | Rabinowitz et al. | |
| 7,148,802 | B2 | 12/2006 | Abbruscato | |
| 7,301,453 | B2 | 11/2007 | Fry | |
| 2006/0022873 | A1 | 2/2006 | Zimmerman | |

OTHER PUBLICATIONS

U.S. Appl. No. 12/350,096, filed Jan. 7, 2009, Giallorenzi.

* cited by examiner

*Primary Examiner* — Tai T Nguyen
(74) *Attorney, Agent, or Firm* — Kirton McConkie; N. Kenneth Burraston

(57) ABSTRACT

An emergency locating system can include emergency transceivers and locator transceivers. The emergency transceivers can be capable of transmission of spread-spectrum encoded messages, and can be actuated by a user to send a distress message. A locator transceiver can be capable of receiving the distress messages and performing two-way ranging to determine a distance between the locator transceiver and the emergency transceiver.

19 Claims, 6 Drawing Sheets

EMERGENCY LOCATING SYSTEM AND METHOD USING SPREAD-SPECTRUM TRANSCEIVER

FIELD

The present application relates to wireless communications. More particularly, the present application relates to techniques for using a spread-spectrum transceiver for emergency locating.

BACKGROUND

There are many instances where it would be useful to be able to determine the location of an individual. For example, in an emergency situation, first responders (e.g., police officers, firefighters, miners) may need to determine where a person in distress is located. Military operations are another example where the ability to locate a soldier in distress is desirable.

The desirability of locating people in an emergency situation is exemplified by the implementation of the enhanced 911 ability in cellular telephones that allow the location of a cell phone being used for a call to the emergency 911 number to be located. Some of these enhanced 911 solutions rely on the Global Positioning System (GPS) to determine the location of the cellular telephone.

Of course, a cellular telephone is not practical in all situations, and will only work in areas which have cellular coverage. While cellular coverage is quite good in populated areas, many sparsely populated areas have little or no cellular coverage. Cellular telephones are also somewhat impractical from a global perspective due to differing frequency allocations and waveforms in use around the world. Another problem is that cellular and other systems require an extensive infrastructure to be deployed.

Reliance on GPS can also present difficulties. While GPS provides worldwide coverage, the GPS signals are easily blocked by heavy vegetation and structures, making GPS receivers unreliable inside buildings, underground, and in heavily vegetated areas. Moreover, GPS receivers tend to be relatively power hungry.

Accordingly, there remains a need for emergency locating systems than use a small, lightweight unit and that do not require an extensive infrastructure or GPS.

SUMMARY

Accordingly, systems and techniques for locating a person in distress using a spread spectrum transceiver to perform two-way ranging have been developed.

In some embodiments of the invention, a method of locating a person in distress can include activating an emergency transceiver by the person in distress. A direct-sequence spread-spectrum distress transmission can be transmitted by the emergency transceiver and received by a locator transceiver. Two-way ranging can be performed between the locator transceiver and the locator transceiver by exchanging messages therebetween and measuring the delay between the exchanged messages.

In some embodiments of the invention, an emergency locating system can include an emergency transceiver and a locator transceiver, each capable of transmitting and receiving spread spectrum encoded signals. A location calculation unit can be interfaced to the locator transceiver and can determine distance between the emergency transceiver and the locator transceiver based on two-way ranging messages exchanged between the emergency transceiver and the locator transceiver.

In some embodiments of the invention, an emergency transceiver device can include a wearable apparatus having an actuator, a transmitter, and a receiver. The actuator can be operatively coupled to the transmitter to transmit a spread-spectrum encoded distress message when the actuator is activated. The transmitter can transmit a spread-spectrum encoded ranging pulse when triggered by the receiver upon receipt of a ranging command by the receiver.

In some embodiments of the invention, a locator transceiver can include a receiver and transmitter. The receiver can be capable of receiving spread-spectrum encoded distress messages. The transmitter can be operatively coupled to the receiver to transmit a spread-spectrum encoded ranging command in response to a received distress message. The receiver can be capable of receiving spread-spectrum encoded ranging messages. A ranging calculator can be operatively coupled to the receiver and calculate a distance between the locator transceiver and the source of the distress messages based on the time delay between transmitted ranging commands and corresponding received ranging messages.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1:
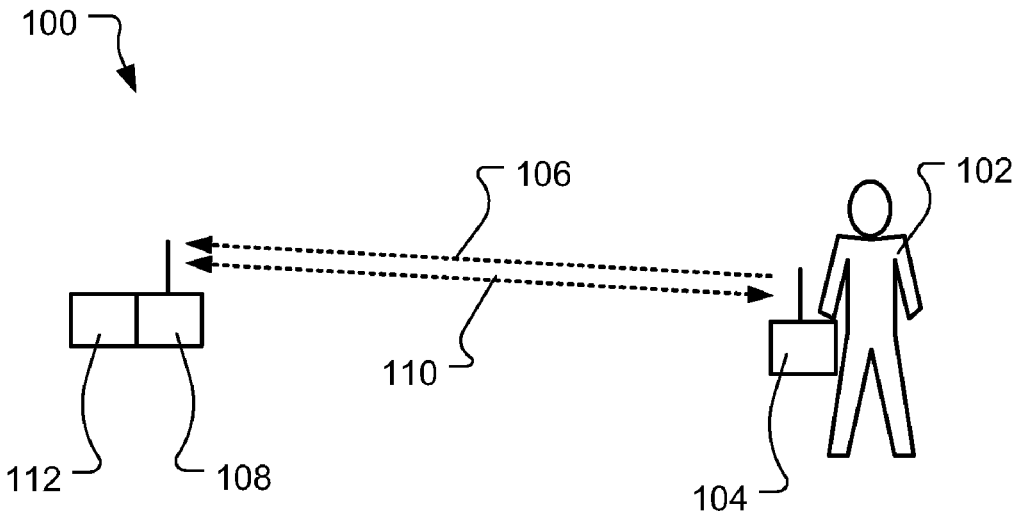
FIG. 1 is a block diagram of an emergency locating system in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to a transmission includes reference to one or more transmissions.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also as including all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Now, returning to the discussion introduced above, it has been recognized by the present inventors that there is a need for emergency locating systems and techniques than can be performed using a lightweight unit that do not require the deployment of an extensive infrastructure and do not rely on the Global Positioning System. Accordingly, in some embodiments of the present invention, a two-way ranging system has been developed that can be deployed in an emergency locating system. The two-way ranging system can use spread-spectrum encoded messages to provide for communication of a distress signal as well as ranging between an emergency transceiver and a locator transceiver. By performing two-way ranging between the individual emergency transceiver and the locator transceiver, an extensive infrastructure is not required. For example, a one-way transmission device would generally need to rely on GPS (or similar system) to provide location information, or would require an extensive infrastructure to allow triangulation (or other locating techniques) to be implemented.

In some embodiments of the present invention, spread-spectrum waveforms can be used. Spread spectrum waveforms, in addition to enhancing the ability to perform ranging, also provide benefits in enabling covert systems which can be helpful in military applications. Application of layered spreading codes, as described in further detail below, can provide for low complexity receivers, allowing both emergency transceivers and locator transceivers to be implemented using lightweight, battery-powered devices. Additional security can be provided by including authorization codes that are entered to enable transmissions from the emergency transceivers and locator transceivers.

FIG. 1 illustrates an emergency locating system in accordance with some embodiments of the present invention. The emergency locating system, shown generally at 100, can provide for communications of a distress signal from a mobile user 102. The mobile user can be, for example, a police officer, a firefighter, or other emergency responder personnel. As another example, the mobile user can be a solider, miner, or other person for which locating that person in an emergency or distress situation is desired. As yet another example, the mobile user can be a mountaineer, backcountry skier, spelunker, parasailer, or other civilian engaged in a risky activity from which rescue may be necessary.

The mobile user 102 can carry an emergency transceiver 104. The emergency transceiver can be capable of transmission and reception of spread-spectrum encoded signals. For example, spread-spectrum encoded distress messages 106 can be transmitted when the emergency transceiver is actuated by the user.

The emergency locating system 100 can also include a locator transceiver 108. The locator transceiver can also be capable of transmission and reception of spread-spectrum encoded signals. In particular, the locator transceiver can be capable of receiving spread-spectrum encoded distress messages 106 transmitted from the emergency transceiver 104 and exchanging two-way ranging messages 110 with the emergency transceiver.

The locator transceiver 108 can include or be interfaced to a locating calculation unit 112 which is capable of determining a distance between the emergency transceiver 104 and the locator transceiver 108 based on the two-way ranging messages 110. The location calculation unit can include a display for displaying the range or distance between locator transceiver and the emergency transceiver. By using the displayed range or distance from the locator transceiver and the emergency transceiver, a rescue user can obtain information related to the location of the mobile user, such as relative distance. For example, a rescue user can determine whether they are moving closer to or further away from the mobile users as the rescue user moves.

While only a single emergency transmitter 104 and a single locator transceiver 108 are illustrated in FIG. 1, it will be appreciated that the system 100 can include more than one of each. For example, a military force may equip substantially all soldiers with emergency transceivers, and provide a number of units with locator transceivers for search and rescue operations. As another example, a group of individuals may have each individual equipped with both an emergency transceiver and locator transceiver to allow any group member to transmit distress messages and any group member to locate a group member in distress.

One benefit of performing two-way ranging is that the emergency transceiver 104 can conserve power (e.g., battery lifetime) by minimizing transmissions. For example, after the initial transmission of a distress message, the emergency transceiver can avoid wasting power by making no further transmissions except when necessary to support the two-way ranging process, or when no ranging command has been received (e.g., indicating that the distress message was not heard). This is in contrast to one-way beacon-type transmitters which have no way of knowing whether a transmitted distress message has been received. With no way to receive an acknowledgement that distress transmissions have been received, a one-way beacon-type transmitter must generally continually transmit the distress message until rescue occurs. Not only can such an approach consume large amounts of power (making it difficult or impractical for small wearable devices), but limited time of operation is generally provided. In contrast, in some embodiments of the present invention, a greatly extended operation time can be provided when the emergency transceiver has been activated, since relative few transmissions may be made by the emergency transceiver.

Another benefit of the two-way ranging system is the ability in some embodiments to provide location information using a single locator transceiver. In contrast, one-way beacon-type transmitters cannot be reliability located without using an extensive infrastructure (e.g., to perform triangulation). While range measurements can be made using relative signal strength, such measurements can result in highly inaccurate range, as the attenuation of signals is highly dependent on the terrain and other environmental factors. Furthermore, in many situations (e.g. urban environments, rubble, a collapsed building, etc.) multipath can be present which can even further confound signal strength based measurements and can cause problems with triangulation techniques.

In accordance with some embodiments of the present invention, using a spread spectrum waveform can allow for accurate ranging to occur. For example, in some embodiments, a chip rate of about 50 MHz corresponds to a chip wavelength of about 20 feet. Time of arrivals can be measured with accuracy of about 10% in some embodiments, enabling ranging accuracy of about 2 feet. This is considerably more accurate than is typically obtained by signal strength type measurements, and exceeds the accuracy of even many GPS-based systems. Moreover, a spread-spectrum waveform can resolve individual reflection components in a multipath signal, helping to avoid losses and inaccuracies caused by interference between the individual reflection components, further improving accuracy relative to other techniques.

Figure 2:
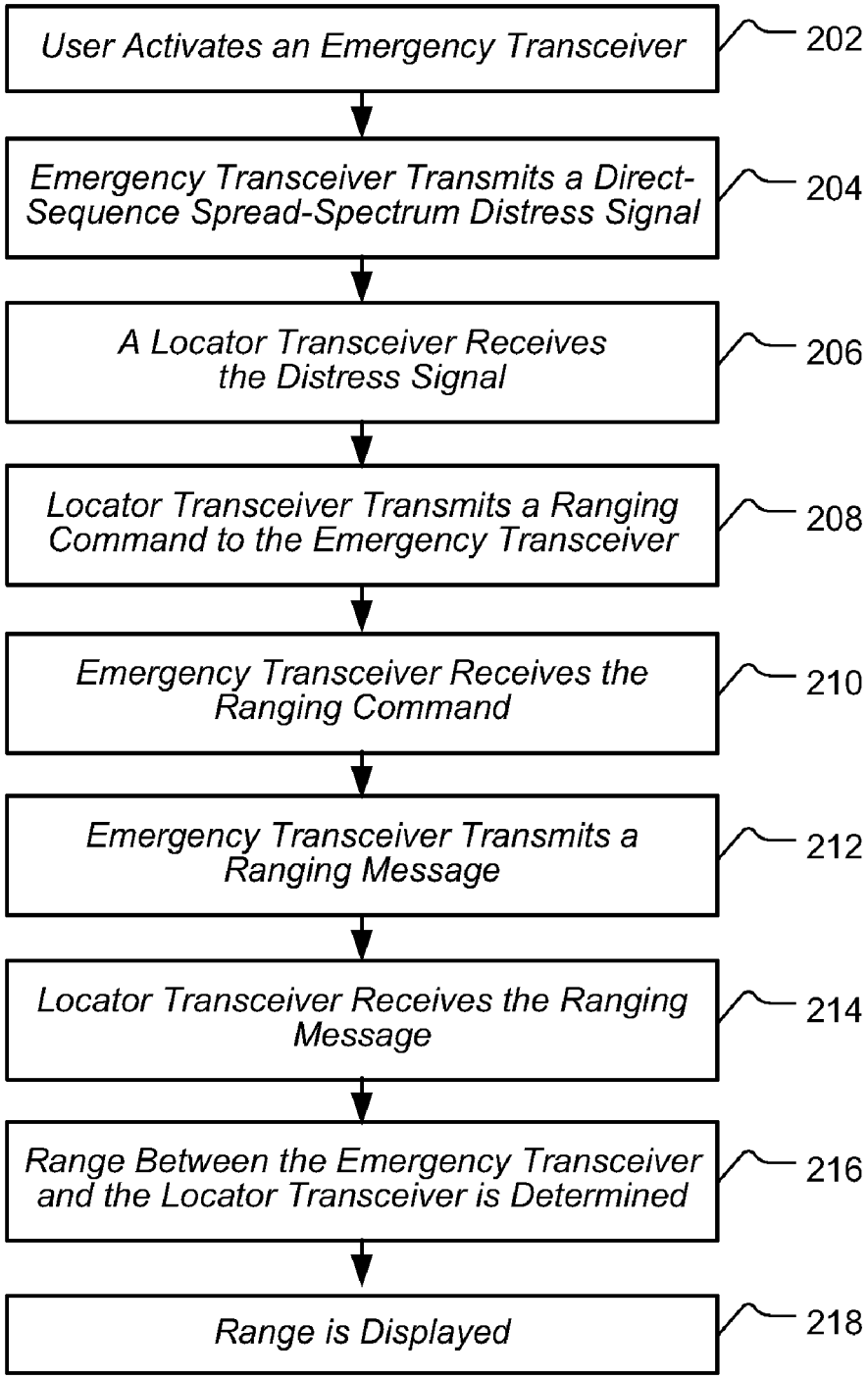
FIG. 2 is a flow chart of a process for performing two-way ranging in accordance with some embodiments of the present invention.

An example of performing two-way ranging will now be described in conjunction with the flow chart of FIG. 2 in accordance with some embodiments of the invention. The process can begin when the user (e.g., a person in distress) activates the emergency transceiver 104 in block 202. The emergency transceiver can make a direct-sequence spread-spectrum distress transmission in block 204 in response to the activation. The distress transmission can be received by the locator transceiver 108 in block 206.

After receiving the distress transmission, two-way ranging can be performed. For example, the locator transceiver 108 can transmit a ranging command to the emergency transceiver 104 in block 208. The ranging command can be received at the emergency transceiver in block 210, and a ranging message transmitted back to the locator transceiver in response to the ranging command in block 212, and then received by the locator transceiver in block 214.

It will be appreciated that there is always a possibility that one or more of the messages in the sequence of transmissions and receptions are not correctly received, for example, due to random noise, interference, or jamming. Accordingly, timeouts and resets can be included, which are not illustrated in detail. For example, if an expected response is not received, the process may be automatically reinitiated (e.g., by retransmission of the ranging command if no response is received). Alternatively, the process may end, and be manually reinitiated (e.g., by the user reactivating the emergency transceiver).

After receiving the ranging message (block 214), the range between the locator transceiver 108 and the emergency transceiver 104 can be determined based on the delay between block 208 and block 214. The range can be determined based on the round trip delay between the transmission of the ranging command and the reception of the ranging message, or more particularly, the time difference between the time of transmission of the ranging command from the locator transceiver and the time of arrival of the ranging response at the locator transceiver. In particular, it will be appreciated that the propagation delay of radio signals is substantially at the speed of light, and thus, based on the propagation delay time, range can be determined. In calculating the propagation delay time, measurements can be performed from the beginning or end of transmissions by taking into account the length of the transmissions.

At this point, it will be appreciated that the ranging technique just described does not rely on GPS. Moreover, there is no requirement that time of day is known by either the emergency transceiver or the locator transceiver. Accordingly, the system need not be supported by an extensive infrastructure, such as is the case for GPS and cellular systems.

Returning to the discussion of the ranging process, there may be additional time delay introduced in the emergency transceiver between receiving the ranging command and transmitting the ranging message. For example, time delay may be introduced due to processing time requirements (e.g., to detect the ranging command), buffering, and other factors. These time delays can be predictable and accounted for in determining the range.

Figure 3:
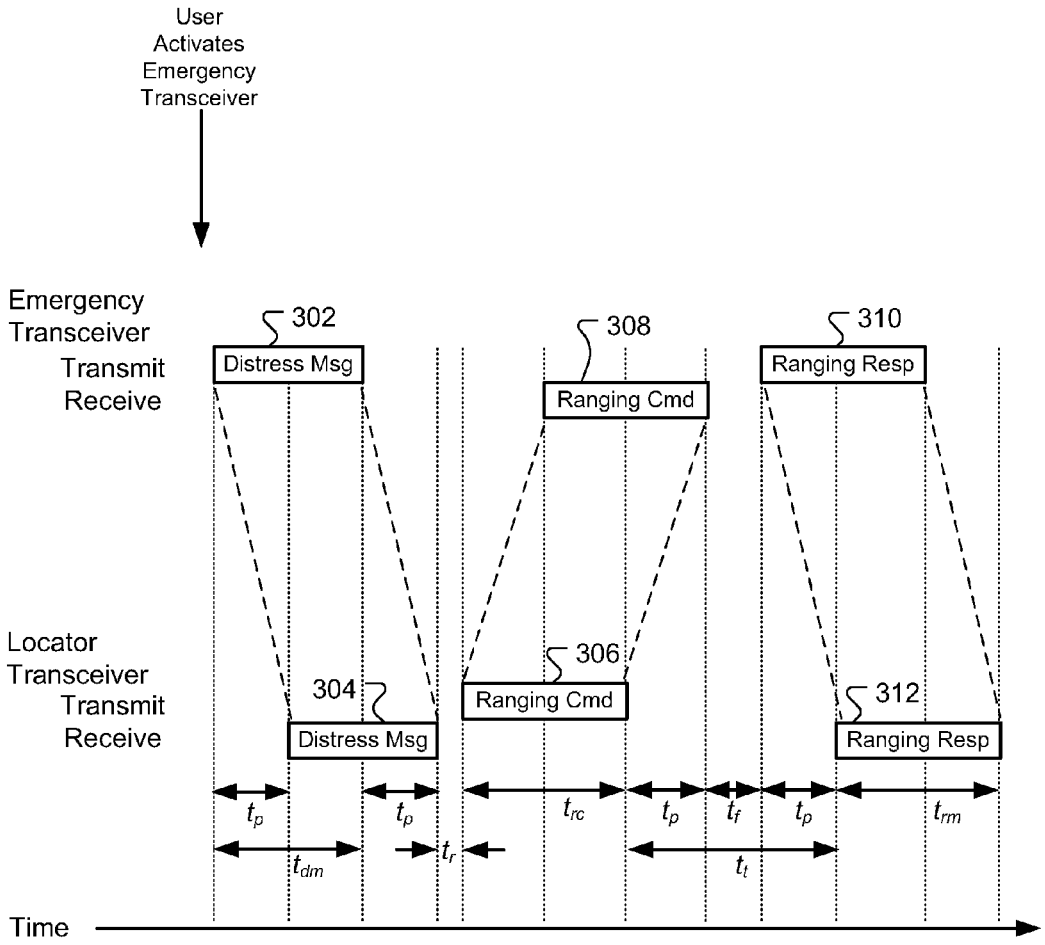
FIG. 3 is a timing diagram showing a two-way ranging process in accordance with some embodiments of the present invention.

FIG. 3 illustrates a timing diagram of the two-way ranging process in accordance with some embodiments of the present invention. The diagram is not to scale, and time intervals may be longer or shorter than pictured in relationship to each other. Time runs from left to right along the horizontal axis. The ranging process begins when the user activates the emergency transceiver causing the distress message 302 to be transmitted. The distress message is received 304 at the locator transceiver after a propagation delay of $t_p$. In response, the ranging command 306 is transmitted and is received 308 at the emergency transceiver, again after a propagation delay of $t_p$. After a fixed processing time delay of $t_f$, the emergency transceiver transmits the ranging response 310, which is received 312 at the locator transceiver after propagation delay of $t_p$. Accordingly, the total delay between the end of the ranging command transmission and the beginning of the ranging response reception is equal to $t_t=t_p+t_f+t_p$. Accordingly, the range, r, between the locator transceiver and the emergency transceiver can be calculated according to the relationship, $r=(t_t-t_f)/2c$, wherein c is the propagation velocity of the radio signals (speed of light). Of course, measurements can be made using other reference points, such as the beginning or ends of messages. In such a case, calculating the range can include taking into account any of the length of the distress message ($t_{dm}$), the ranging command ($t_{rc}$), and the ranging message ($t_{rm}$) as appropriate in making the calculations. It will be appreciated that there may be additional delays related to detecting received transmissions in the emergency transceiver, locator transceiver, or both that can also be accounted for in a manner similar to $t_f$.

It will be noted that the ranging command need not be immediately transmitted by the locator transceiver upon receipt of the distress message, as shown by time interval $t_r$. For example, as discussed further below, transmission of the ranging command from the locator transceiver may be inhibited until an authorization code is entered by a rescue user through a user interface of the locator transceiver. Accordingly, the time interval $t_r$ may be quite long—on the order of many seconds or even minutes, in contrast to the other time intervals depicted which may be on the order of milliseconds.

If desired, power and/or rate control can be included to allow the transmit power of the emergency transceiver to be reduced when the range between the emergency transceiver and the locator transceiver becomes shorter. This can help to reduce power consumption and increase power source lifetime in the emergency transceiver. If desired, the power control can increase the available system margin as the range is reduced, helping to increase ranging accuracy as the range becomes smaller.

Figure 4:
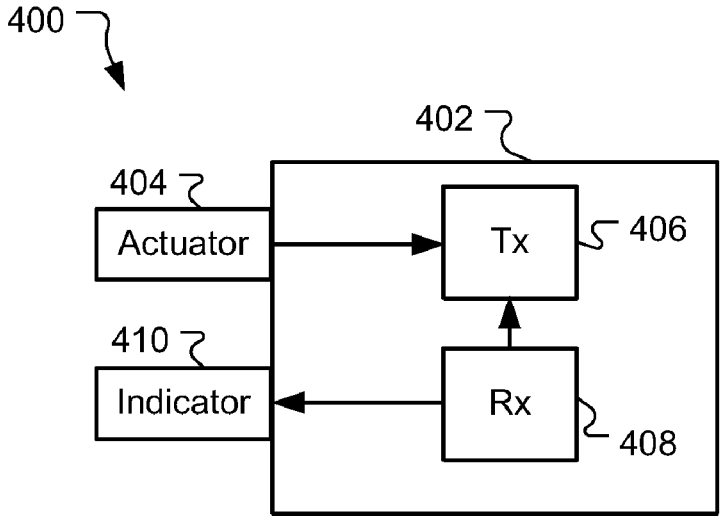
FIG. 4 is a block diagram of an emergency transceiver in accordance with some embodiments of the present invention.

Now, an example implementation of the emergency transceiver will be described. FIG. 4 illustrates a block diagram of an emergency transceiver in accordance with some embodiments of the present invention. The emergency transceiver, shown generally at 400, can be in the form of a wearable apparatus 402. For example, the emergency transceiver can be disposed in a pendant, a watch, an identification card, a shirt button, or similar arrangements. The wearable apparatus can include an actuator 404. The actuator can be, for example, a push button.

The emergency transceiver 400 can include a transceiver comprising a spread-spectrum transmitter 406 and spread-spectrum receiver 408. The transceiver can transmit spread-spectrum encoded messages. For example, when the actuator is actuated, the transmitter can transmit a distress message as described above. When the receiver has received a ranging command, it can trigger the transmitter to transmit a ranging response.

The emergency transceiver 400 can include an indicator 410 which can be used to display an indication to the user that a ranging command has been received. This can help to provide reassurance to the user that the distress transmission has been received. Various indicators can be used, including for example, a visual indicator (e.g., a light), a haptic indicator (e.g., a vibrator), an audible indicator (e.g., a speaker), other user-perceivable indicators, or combinations thereof. Such an indication can be of comfort to the distressed user.

Although not shown in FIG. 4, the emergency transceiver 400 can include one or more antennas. For example, the emergency transceiver can share an antenna between the transmitter 406 and receiver 408, for example, using an antenna switch. The antenna may be disguised as a portion of the wearable apparatus. For example, the antenna may be a casing in which all or some of the components of the emergency transceiver are packaged, a lanyard connected to the wearable apparatus, a watchband, or similar.

The emergency transceiver can also include components (not shown) such as upconverters, downconverters, modulators, mixers, demodulators, frequency references, code generators, spreaders, despreaders, filters, processors, and similar components used in transmitters and receivers. The emergency transceiver can also include a power source (not shown), such as, for example, a battery, solar panel, hand crank, or other power generating means.

Various ways of actuating the emergency transceiver 400 can be used. For example, in some applications, a simple press of a push-button type actuator can be used to initiate distress message transmission. In other applications, an authorization code can be implemented, wherein the distress message transmission is activated by entry of the authorization code. The authorization code can be, for example, a sequence of push button inputs (e.g., a pattern of long and short presses, a pattern of a number of presses separated by pauses, or similar arrangements). If more than one actuator is provided, such as for example, multiple push buttons, the authorization sequence can be a sequence of one or multiple button presses (e.g., as for a cipher lock). A watch bezel can be operated in a manner similar to a combination lock to enter an authorization sequence.

Use of an authorization code can prove helpful in situations where the emergency transceiver could fall into the hands of an adversary, such as a military situation. For example, without an authorization code, a captured emergency transceiver could be used by hostile forces to lure friendly forces into an ambush. Inclusion of an authorization code can also prove helpful in other situations to avoid unauthorized uses of the emergency transceiver.

Use of an authorization code can also allow for identification of a particular user or particular emergency transmitter. For example, authorization codes can be associated with individuals, and information related to the authorization code and/or individual can be transmitted in the distress message to enable identifying which individual is in distress.

Figure 5:
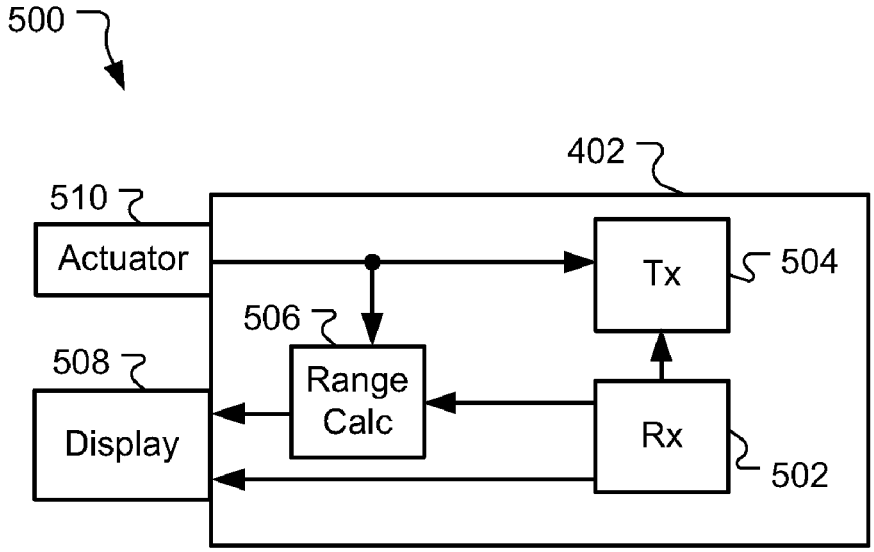
FIG. 5 is a block diagram of a locator transceiver in accordance with some embodiments of the present invention.

Turning to the locator transceiver, FIG. 5 illustrates a locator transceiver in accordance with some embodiments of the present invention. The locator transceiver, shown generally at 500, can include a spread-spectrum receiver 502 and a spread-spectrum transmitter 504. As described above, the receiver can be capable of receiving distress messages and ranging messages from an emergency transceiver. Also, as described above, the transmitter can be capable of transmitting ranging commands, for example in response to received distress messages.

The locator transceiver can include a ranging calculator 506 interfaced to the receiver 502. The ranging calculator can calculate a distance between the locator transceiver device and the emergency transceiver based on a time delay between a transmitted ranging command and a corresponding received spread spectrum encoded ranging message, for example as described above.

The locator transceiver can include a user interface, such as a display 508 and actuator 510. The display can be used to provide an indication that a distress message has been received. While the display can provide a visual indicator (e.g., a text readout), audible or haptic output can be used in place of or in addition to a visual indicator. Also, as noted above, the distress message can include information allowing the individual in distress to be identified, which can be displayed on the display. The display can also display range between the locator transceiver and the emergency transceiver. The display can be remotely located from the locator transceiver.

The actuator 510 can be used to allow entry of an activation code by a rescue user in a similar manner as described above for the emergency transceiver. For example, the activation code can be used to preclude unauthorized use of the locator transceiver. As a particular example, the activation code can be helpful to reduce the usefulness of a locator transceiver captured by an adversary in a military situation.

Although not shown in FIG. 5, the locator transceiver 500 can include one or more antennas, similar to that described above for the emergency transceiver. The locator transceiver can also include other components (not shown), similar to those described above for the emergency transceiver.

Turning to the details of spread spectrum transmitters and receivers, in some embodiments of the present invention, the same waveform and/or the same spreading code can be used for the transmitter and receiver. This can help to simplify the implementation and management of the system.

Traditionally, spread spectrum has been viewed as too complex and processing intensive for use in lightweight mobile devices. While advances have been made in some spread spectrum systems, many applications of spread spectrum remain relatively power hungry. In contrast, lower power usage can be obtained in some embodiments of an emergency locating system by the application of layered spreading codes which allows for simplification in the processing to be implemented in a receiver.

Figure 6:
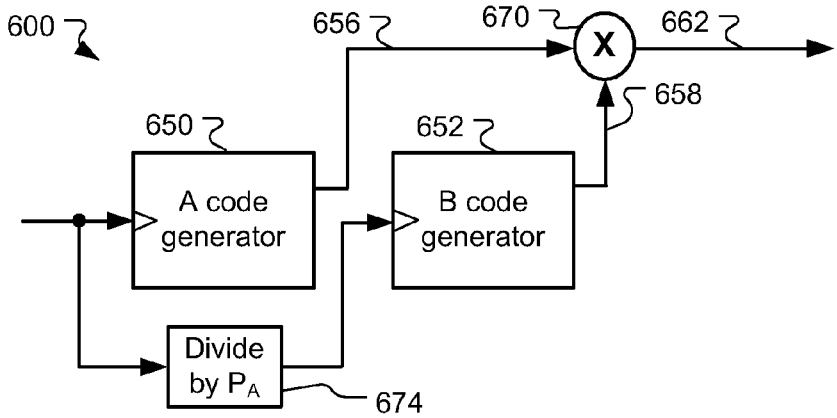
FIG. 6 is a detailed block diagram of a layered spreading code generator in accordance with some embodiments of the present invention.

Layered spreading codes can be created by combining several relatively short pseudonoise codes to create a longer pseudonoise code. For example, FIG. 6 illustrates a spreading code generator 600 in accordance with some embodiments of the present invention. The spreading code generator can generate a two level pseudonoise code, referred to here as the AB code. The AB code is produced using two sub-code generators 650, 652, which produce respectively an A code 656 having length $P_A$, and a B code 658 having length $P_B$. The A-code generator is clocked at the chip rate, and thus the A code repeats every $P_A$ chips. The B-code generator is clocked at $1/P_A$ of the chip rate through a divider 674, and the B code repeats every $P_A*P_B$ chips, but only changes after every $P_A$ chips. The component codes are combined with a multiplier (exclusive OR) 670. By multiplying the A-code and the B-code together, the AB code 662 is obtained which changes every chip, and repeats every $P_A*P_B$ chips.

While two levels of code are sufficient to create a layered code, more levels can be used by adding additional stages, duplicating multiplier 670, divider 674, and providing additional code generators.

The resulting code can be described in terms of the individual chips of the component sub-codes as follows. Designating the chips of the A-code as $A_1 \ldots A_{PA}$ and the chips of the B-code as $B_1 \ldots B_{PB}$, the resulting code sequence can be expressed as: $A_1B_1$, $A_2B_1$, $A_3B_1 \ldots A_{PA}B_1$, $A_1B_2$, $A_2B_2$, $A_3B_2, \ldots A_{PA}B_2, A_1B_3 \ldots A_{PA}B_{PB}$. The resulting code can be used for direct-sequence spreading by, for example, exclusive or-ing the code with data to be transmitted, modulation a carrier with the code, or other appropriate arrangements. Layered spreading codes can be applied in a spread spectrum transmitter used in either the emergency transceiver, the locator transceiver, or both, in accordance with some embodiments of the present invention.

Figure 7:
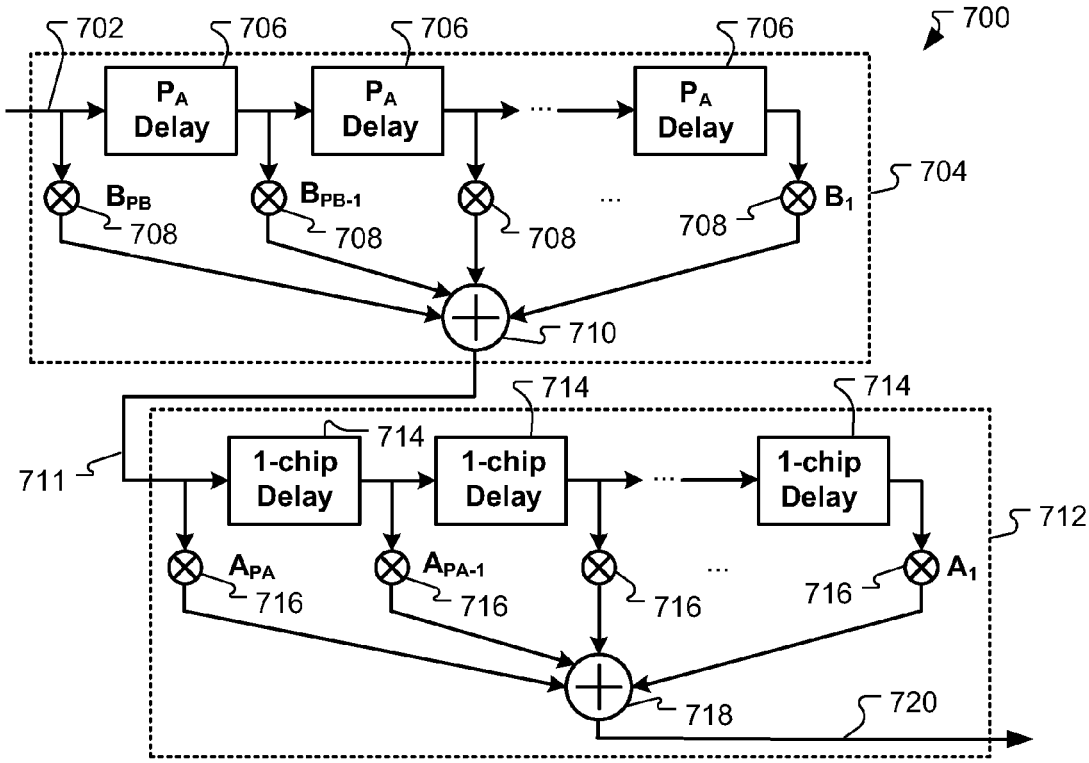
FIG. 7 is a detailed block diagram of a layered despreader in accordance with some embodiments of the present invention.

Benefits of using a layered spreading code can be obtained in a receiver which uses a layered despreader. FIG. 7 illustrates a block diagram of a layered despreader in accordance with some embodiments of the present invention. The spreader 700 can be used, for example to despread a direct-sequence spread-spectrum encoded signal that has been encoded with a layered spreading code using the spreading code generator of FIG. 6.

The input 702 to the despreader can be, for example a complex baseband digitized signal. The despreader can include two correlation sections 704, 712, corresponding to each of the component sub-codes. The first section 704 can include a tapped delay line formed by a series of delay units 706 each providing a delay of $P_A$ chips. As described above, the A-code code repeats every $P_A$ chips, hence, for a properly time-aligned input signal, only the B-code portion of the input signal chips are different between each delay unit. Hence, the outputs of the tapped delay line can be multiplied by the B code using multipliers (exclusive ORs) 708, and then summed in a summer 710. The resulting output 711 from the first section has thus had the B code removed.

The second section 712 uses a tapped delay line with delay units 714 having delays of one chip time and, using multipliers 716 and a summer 718, correlates against the A code to form the final correlation result 720.

Codes with more layers can be accommodating by adding additional sections to the despreader, like the first section 704, using appropriate delays in delay lines similar to the delay lines 706 shown here and appropriate code coefficient multiplications similar to the multipliers 708 shown here.

This structure is considerably simpler than a conventional correlator for a non-layered code. For example, for a code of length 10,000, a conventional correlator would require 10,000 coefficient storage locations and multipliers. Moreover, for each input chip coming in, a sliding correlation would require performing 10,000 multiply-accumulate operations. In contrast, a layered code of length 10,000 can be formed using two component codes of length 100. Thus, 200 coefficient storage locations and multipliers can be used (as compared to 10,000). While more delays and memory may be used by the layered code as compared to a conventional code, the resulting reduction in computation complexity is typically worth this small cost. For example, using the layered code, for each input chip 200 multiply accumulates can be performed to obtain the final correlation result (as compared to 10,000 for a conventional correlator)—a reduction factor of over 50.

Of course, layered codes are not limited to two layers, as described herein, nor are they limited to the particular code lengths described above. Various numbers of layers can be used, and differing code lengths can be used for each layer.

Further, while the delays illustrated above are shown as being multiples of integer chip vales, sub-chip delays can also be used, e.g. delays of ½ or ¼ chip time to provide for greater timing resolution and reduced loss.

Layered despreading can be performed in a spread spectrum receiver used in either the emergency transceiver, the locator transceiver, or both, in accordance with some embodiments of the present invention.

The discussion above has focussed primarily on obtaining a single range measurement between the emergency transceiver and the locator transceiver. If desired, multiple ranging measurements can be obtained, for example, when a rescue user is attempting to move toward the person in distress who initiated the distress message transmission. Ranging measurements can be initiated by various means. For example, the locator transceiver can periodically retransmit ranging commands to obtain additional ranging measurements between the locator transceiver and the emergency transceiver. As another example, the locator transceiver can retransmit ranging commands when initiated by the rescue user (e.g., by activating an actuator on the locator transceiver).

Figure 8:
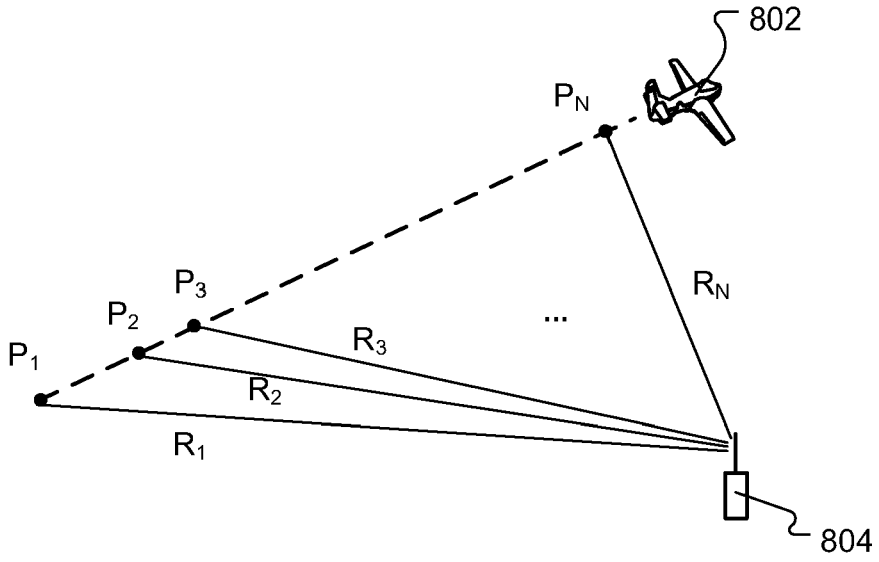
FIG. 8 is an illustration showing one possible mode of operation of an emergency locating system in accordance with some embodiments of the present invention.

If desired, a moving locator transceiver can provide additional information to the location calculation unit to enable the location calculation unit to determine additional information relative to the location of the emergency transceiver. For example, as illustrated in FIG. 8, range between the locator transceiver 802 and an emergency transceiver 804 can be determined from several different positions (e.g., $P_1$, $P_2$, . . . $P_N$) while the locator transceiver is moving. By combining information regarding the positions (e.g., coordinates or relative distances from each other) with ranges obtained from each position (e.g., $R_1$, $R_2$, . . . $R_N$). For example, using knowledge of the positions and ranges, trilateration or multilateration techniques can be used to determine a geographic position of the emergency transceiver. As another example, the range measurements and relative distances between the positions can be solved geometrically to determine distance and bearing information of the emergency transceiver relative to the locator transceiver. As a particular example, the locator transceiver can be positioned on an airborne platform having geographic position information, and plural range measures made while the airborne platform flies along a straight or curved trajectory.

Figure 9:
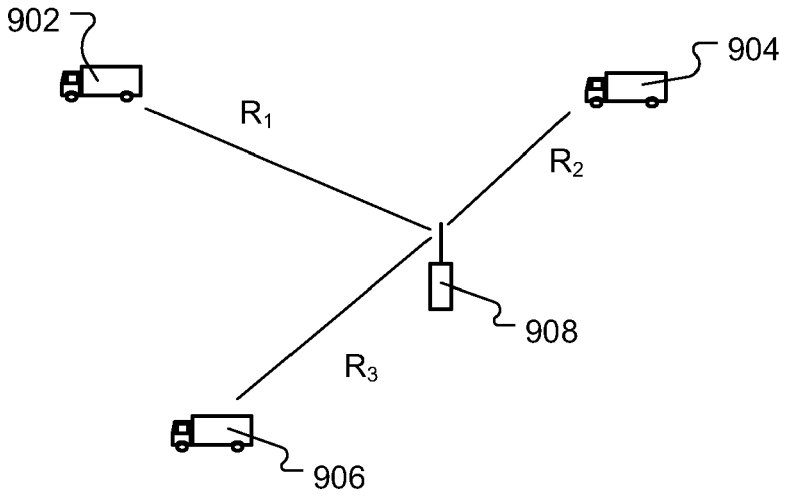
FIG. 9 is an illustration showing another possible mode of operation of an emergency locating system in accordance with some embodiments of the present invention.

The discussion above has primarily focussed on examples of operation where a single locator transceiver is used to determine a range between the locator transceiver and an emergency transceiver. As mentioned above, however, an emergency locating system can include multiple locator transceivers. In accordance with some embodiments of the invention, multiple locator transceivers can be used cooperatively to provide additional location information regarding a mobile user. For example, as shown in FIG. 9, multiple range measurements (e.g., $R_1$, $R_2$, . . . $R_N$) from different locator transceivers 902, 904, 906 to an emergency transceiver 908. Two-way ranging measurements can be made between each of the locator transceivers and the emergency transceivers, for example, transmitting ranging commands from each of the locator transceivers to the emergency transceiver, and measuring the round trip delay of the individual ranging responses. Range measurements can be combined using geometric calculations, trilateration, multilateration, or similar techniques.

Ranging transmissions (e.g., ranging commands and ranging responses) initiated by differing locator transceivers can be distinguished from each other by including unique identifiers within the transmissions. By using a relatively large processing gain (ratio of chip rate to data rate), interference between overlapping transmissions can be avoided. Each transmission can use the same spreading code, but provided that overlapping transmissions (e.g. ranging commands transmitted from different locator transceivers) are separated in time by several chip times, little interference is likely to result.

Summarizing and reiterating to some extent, a technique emergency locating has been developed. The technique uses spread spectrum processing techniques to allow relative positioning information to be obtained between a locator (rescue) unit and an emergency (distress call) unit. The emergency unit can be packaged in a wearable apparatus, making it convenient to maintain on the user's person. Activation of the emergency unit can be as simple as pressing a panic button, or can require activation using coded patterns to provide enhanced security. Multiple locator units can be used in a cooperative manner to provide increased location information.

While a number of illustrative applications have been illustrated, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

What is claimed is:

1. A method for locating a person in distress comprising:

activating an emergency transceiver to generate a direct-sequence spread-spectrum distress transmission by a person in distress;

receiving the direct-sequence spread-spectrum distress transmission at a locator transceiver;

transmitting a ranging command from the locator transceiver to the emergency transceiver;

receiving the ranging command at the emergency transceiver; and transmitting a direct-sequence spread-spectrum ranging message from the emergency transceiver to the locator transceiver in response to the ranging command;

receiving the direct-sequence spread-spectrum ranging message at the locator transceiver;

determining a range between the emergency transceiver and the locator transceiver based on delay between the transmitting a ranging command and the receiving the direct-sequence ranging message; and displaying the range to a rescue user.

2. The method of claim 1, wherein the activating comprises entering an authorization code into the emergency transceiver by the person in distress.

3. The method of claim 1, wherein the transmitting a ranging command comprises transmitting the ranging command upon entry of an authorization code by a rescue user.

4. The method of claim 1, further comprising displaying an indication to the person in distress in response to reception of the ranging command at the emergency transceiver.

5. The method of claim 1, wherein the direct-sequence spread-spectrum distress transmissions comprises a layered spreading code.

6. The method of claim 1, wherein the direct-sequence spread-spectrum distress transmission and the ranging command uses a common spread-spectrum waveform encoding.

7. The method of claim 1, wherein the determining a range comprises:

measuring a time of arrival of the spread-spectrum ranging message at the emergency transceiver;

determining a time difference between the time of arrival and a time of transmission of the ranging command;

converting the time difference to a range while taking into account a predefined time delay between the receiving the ranging command and the transmitting a direct-sequence spread-spectrum ranging message implemented in the emergency transceiver.

8. The method of claim 1, further comprising:

determining a plurality of ranges between the emergency transceiver and a plurality of locator transceivers; and using the plurality of ranges to determine a location of the emergency transceiver.

9. The method of claim 8, wherein the determining a plurality of ranges comprises:

transmitting a ranging command from each of the plurality of locator transceivers to the emergency transceiver;

receiving the ranging commands at the emergency transceiver; and transmitting a direct-sequence spread-spectrum ranging message from the emergency transceiver to each of the plurality of locator transceivers in response to each ranging command;

determining a range between the emergency transceiver and each of the plurality of locator transceivers based on round trip propagation delay; and combining to the range between the emergency transceiver and each of the plurality of locator transceivers to determine a location of the emergency transceiver.

10. The method of claim 1, further comprising:

transmitting a plurality of ranging commands from the locator transceiver to the emergency transceiver from a plurality of different locator transceiver locations;

receiving the plurality of ranging commands at the emergency transceiver;

transmitting a plurality of direct-sequence spread-spectrum ranging messages from the emergency transceiver to the locator transceiver in response to the ranging commands;

determining a plurality of range between the emergency transceiver and the locator transceiver corresponding to each of the plurality of ranging commands;

calculating a location of the emergency transceiver based on the plurality of ranges and the plurality of different locations.

11. An emergency locating system for communications of a distress signal from a mobile unit, the system comprising:

an emergency transceiver configured to transmit of spread-spectrum encoded messages when actuated by a user and configured to receive of spread-spectrum encoded commands; and a locator transceiver configured to transmit of spread-spectrum encoded commands and reception of spread-spectrum encoded message to perform two-way ranging with the emergency transceiver; and a location calculation unit operatively coupled to the locator transceiver and configured to determine a distance between the emergency transceiver and the locator transceiver based on the two-way ranging wherein the locator transceiver comprises: a locator transmitter configured to transmit the direct-sequence spread-spectrum commands;

a locator receiver configured to receive the spread-spectrum encoded messages from the emergency transceiver, wherein the locator transmitter transmits a ranging command in response to a received distress message; and wherein the location calculation unit calculates range based on a time delay between the transmission of a ranging command and the reception of a ranging message.

12. The system of claim 11, wherein the emergency transceiver comprises:

an emergency transmitter configured to transmit the direct-sequence spread-spectrum encoded messages;

an emergency receiver configured to receive the direct-sequence spread-spectrum encoded ranging commands and operatively coupled to the emergency transmitter to initiate transmission of ranging messages in response to ranging commands; and an actuator operatively coupled to the emergency transmitter to initiate transmission of distress messages when the actuator is operated.

13. The system of claim 12, wherein the emergency transmitter transmits a distress message in response to a predefined authorization code entered through the actuator.

14. The system of claim 11, wherein the locator transmitter transmits a ranging command in response to a predefined authorization code entered into the locator transceiver.

15. The system of claim 11, wherein the locator transceiver comprises a display operatively coupled to the location calculation unit to display the distance between the emergency transceiver and the locator transceiver.

16. The system of claim 11, wherein the spread-spectrum encoded messages and the spread-spectrum encoded commands are each encoded using a layered spreading code.

17. The system of claim 11, wherein the spread-spectrum encoded messages and the spread-spectrum encoded commands are each encoded using the same waveform.

18. The system of claim 11, further comprising:

a plurality of locator transceivers each capable of transmission of spread-spectrum encoded commands and reception of spread-spectrum encoded message to perform two-way ranging with the emergency transceiver; and wherein the location calculation unit is in communication with each of the plurality of locator transceivers and capable of combining two-way ranging information from each of the locator transceivers to determine a location of the emergency transceiver.

19. The system of claim 11, wherein the emergency transceiver does not include a global positioning system receiver.

* * * * *